US005621973A

United States Patent [19]

Seber et al.

[11] Patent Number: 5,621,973

[45] **Date of Patent: *Apr. 22, 1997**

[54] LOCKABLE FOLDING KNIFE WITH ROLLOVER BLADE SELECTION

[75] Inventors: Brett P. Seber, Escondido; Roy L. Helton, Jr., San Diego, both of Calif.

[73] Assignee: Buck Knives, Inc., El Cajon, Calif.

[ * ] Notice: The term of this patent shall not extend beyond the expiration date of Pat. No. 5,537,750.

[21] Appl. No.: 445,579

[22] Filed: May 22, 1995

Related U.S. Application Data

[63] Continuation of Ser. No. 138,670, Oct. 18, 1993.

[51] Int. Cl.[6] ..... B26B 1/04

[52] U.S. Cl. ..... 30/161; 30/160

[58] Field of Search ..... 30/160, 161, 329, 30/331; 7/118–120

[56] References Cited

U.S. PATENT DOCUMENTS

| | | | |
|---|---|---|---|
| 237,138 | 2/1881 | Slayton . | |
| 280,150 | 6/1883 | Dubois . | |
| 689,513 | 12/1901 | Papendell . | |
| 825,093 | 7/1906 | Watson | 30/161 |
| 1,510,420 | 9/1924 | Sherman . | |
| 1,545,542 | 7/1925 | Albrecht et al. . | |
| 1,828,121 | 10/1931 | Adam et al. . | |
| 2,718,695 | 9/1955 | Elsener . | |
| 2,809,384 | 10/1957 | Kayser . | |
| 2,896,290 | 7/1959 | Salm et al. . | |
| 3,415,250 | 12/1968 | Peterson . | |
| 4,078,272 | 3/1978 | Mahon, III . | |
| 4,730,394 | 3/1988 | Sonner | 30/161 |
| 4,805,303 | 2/1989 | Gibbs . | |
| 4,856,132 | 8/1989 | Burns et al. . | |
| 4,896,424 | 1/1990 | Walker . | |
| 4,947,552 | 8/1990 | Barnes | 30/161 |
| 4,985,998 | 1/1991 | Howard . | |
| 5,009,008 | 4/1991 | Yablonovitch . | |
| 5,044,079 | 9/1991 | Gibbs | 30/160 |

FOREIGN PATENT DOCUMENTS

| | | | |
|---|---|---|---|
| 91378 | 11/1921 | Switzerland | 7/118 |
| 117410 | 7/1918 | United Kingdom . | |

OTHER PUBLICATIONS

Declaration of Michael Walker (May 10, 1995), with two attachment pages.

Single untitled photograph of closed knife.

Advertisement for Edgeco Tactical One Hander Knife, *Shooting Times*, Dec. 1993, p. 26.

*Primary Examiner*—Douglas D. Watts

*Attorney, Agent, or Firm*—Gregory Garmong

[57] ABSTRACT

A folding knife has a knife body and at least two blades pivotably mounted to the knife body. The blades are independently movable between a closed position within the knife body and an open position extended from the knife body. The blades are locked in the open position and released from the locking with a single hand of the user. The knife includes a blade selector feature which allows the user to select which blade is to be opened by rolling the knife about the knife longitudinal axis in the single hand of the user, and tactile coding so that the user can identify the position of the knife from its feel in the hand.

5 Claims, 7 Drawing Sheets

LOCKABLE FOLDING KNIFE WITH ROLLOVER BLADE SELECTION

This application is a continuation, of application Ser. No. 08/138670, Oct. 18, 1993.

BACKGROUND OF THE INVENTION

This invention relates to a folding knife with at least two lockable folding blades, and, more particularly, to such a knife wherein the selection and opening of the blade to be used is accomplished easily with one hand.

Knives are commonly available with either fixed blades or extendable blades. The fixed blade knife, whose blade is permanently fixed in the extended position, is popular with outdoorsmen because it is strong and can be provided with features particularly useful in hunting, fishing, and other outdoor activities.

The extendable blade knife, on the other hand, can be provided with multiple blades and many more features than the fixed blade knife. The extendable blade knife is also more compact than the fixed blade knife for carrying and storage. The most popular type of extendable blade knife is the folding blade knife, and the present invention relates to such folding blade knives.

More particularly, it relates to such knives having at least two blades that are normally folded into the knife body, can be independently selected by the user, and then can be selectively rotated to an opened position for use.

The folding blade knife has a knife body and at least one pivot pin. The blades are pivotably mounted to the pivot pin or pivot pins. The knife usually has a retention mechanism to hold the blades in the closed position within the knife body, until the user of the knife selects one of the blades for use. The selected blade is controllably extended by rotating it about its pivot pin to the open position. The locking mechanism then locks the selected blade in the open position in a manner that permits later selective unlocking of the blade and rotating it back to the original closed position.

Although the folding knife has many advantages, existing models have shortcomings in some applications. As an example, the use of a folding knife having more than one blade typically requires the user to visually inspect the knife to find the blade to be used. Once the desired blade is identified, the user holds the knife body in one hand and grasps the sides of the blade in the other hand. The blade is pivoted about its pivot point from the closed to the open position in a circular motion with both hands. The knife and blade are then used in the desired manner, usually holding the knife body in only one hand.

At a later time, the user of the knife may see the need for the use of a different blade. To select and deploy a different blade, the user again grasps the body of the knife in one hand and the opened blade in the other, releases the open-position lock, and folds the blade to the closed position with the reverse of the opening movement. The user visually inspects the knife to find the other blade to be used, and repeats the opening procedure described above. For some knife designs, the user may have t: reverse the knife end-for-end to position the other blade for opening.

Each time the knife is used, the user of the knife must divert attention from the ultimate use of the knife to find the blade to be deployed. The user must employ both hands to open and close the knife. Since the ultimate holding of the knife usually requires only one hand, the user must release the grasp of any object in the other hand in order to open the knife or to change blades. And, in each case, the user must divert primary attention from the task at hand to the knife. For many knife applications, this sequence of events in the use of the knife and its shortcomings do not pose a problem. In other situations, it poses serious obstacles. To cite an example, when a law enforcement officer or emergency rescue worker seeks to rescue an injured person trapped in a vehicle, a conventional cutting blade may be used to cut away a portion of an article of clothing worn by the trapped person in order to gain access to the seat belt that holds the person in place. A specially adapted web cutting tool is then used to cut through the seat belt harness that holds the person in place. Both the conventional blade and the web cutting tool are conveniently provided in a folding knife.

The rescue is often accomplished in a confined space under highly adverse conditions such as near-total darkness. With a conventional folding knife, the user of the knife must divert attention from the person being rescued to the knife, and must release the grip on the person or seat belt being cut to close the conventional blade and open the web cutting tool. Within the confined space and in darkness, it may not be possible to see the knife to select the blade. These problems can result in confusion and the loss of time in the rescue. While this example highlights the problem, the same difficulties can arise in many other uses of folding knives.

Thus, there is a need for an improved knife that offers greater selectivity and control in managing the use of the knife, particularly in adverse circumstances. The present invention fulfills this need, and further provides related advantages.

SUMMARY OF THE INVENTION

The present invention provides a folding knife having at least two blades. The blades are pivoted about a common pivot pin so that the knife need not be reoriented end-for-end to use the different blades. A desired blade In its closed position can be identified, selected, deployed to its open position, locked into the open position, used, unlocked, and closed entirely with one hand, the hand that is to hold the knife during use of the blade. These functions are accomplished without visually inspecting the knife or diverting primary attention to the knife, and also without releasing the grasp of the other hand on an object. After one blade is used and another is to be selected and used, the one blade is closed and the other blade is selected and deployed by the above process, again using only one hand and without viewing the knife or diverting primary attention to the operation of the knife. In a preferred embodiment, the knife of the invention is locked in the opened position by a positive lock that does not permit the blade to be unintentionally closed during its use.

In accordance with one embodiment of the invention, a knife body having a first knife side and a second knife side, and a common blade pivot pin extending between the first knife side and the second knife side. A first blade is pivotably joined to the knife body at the pivot pin and is disposed within the knife body in a first blade closed position. The first blade is pivotable in a first rotational direction about the pivot pin to a first blade open position. A second blade is pivotably joined to the knife body at the pivot pin and disposed within the knife body in a second blade closed position. The second blade is pivotable in a second rotational direction about the pivot pin to a second blade open position. The knife further includes locking means for controllably locking the first blade in the first blade open position and for independently and controllably locking the second blade in the second blade open position.

Is used herein, the terms "lock" and "locking" are used in their broadest sense of a structure that holds a blade in a desired position until some force causes the blade to pivot from that desired position. The term can include both positive locks which must be released by the user of the knife to cause the blade to pivot, and spring locks which held the blade at the location until a spring force is overcome. The spring lock is not a positive lock, inasmuch as the blade can be moved from the locked position solely by the forces experienced during the user of the knife, and without a specific releasing and unlocking action by the user of the knife.

In another embodiment, a folding knife comprises a knife body having a first knife side, a second knife side, a knife top, and a knife bottom. A first blade is pivotably joined to the knife body and retained within the knife body in a closed position. The first blade is pivotable in a first pivoting plane from the knife top to an open position. A second blade is pivotably joined to the knife body and retained within the knife body in a closed position. The second blade is pivotable in a second pivoting plane parallel to the first pivoting plane from the knife bottom to an open position. The knife further includes means for operating the knife with a single hand of a user of the knife. (As used herein, "a single hand" means one, and only one, hand.) This means for operating includes means for selecting between the first and second blades for use and for orienting the knife so that the selected blade opens away from the single hand of the user, means for opening the selected blade from its closed to its open position, means for locking the selected blade in its open position, and means for selectively unlocking the selected blade and for closing the blade from its open position to its closed position.

In a further embodiment, A folding knife comprises a knife body having a first knife side, a second knife side, a knife top, a knife bottom, and a knife longitudinal axis. There is at least a first blade and a second blade joined to the knife body, each blade being movable from a closed position within the knife body to an open position extended from the knife body. The knife includes means for selecting between the first blade and the second blade for moving from its closed position to its opened position. The means for selecting is operable at least in part by rolling the knife about the knife longitudinal axis in a single hand of a user of the knife. The means for selecting includes coding means on an external surface of the knife body, and located on at least one of the first knife side and the second knife side, for tactilely distinguishing the first knife side from the second knife side.

Thus, preferably, the first blade pivots in one rotational direction from the knife top to the open position, and the second blade pivots in the opposite rotational direction from the knife bottom to the open position. The knife is held such that the blade to be used is positioned to unfold from the closed to the open position away from the hand of the user. With this arrangement, the user of the knife selects the blade to be used by rolling the knife in the hand by 180 degrees about its longitudinal axis.

The knife is coded so that the user can identify the position of the knife, and therefore the blade positioned for use, by touch. The user therefore does not need to visually inspect the knife in order to select the blade to be used and orient the knife for deploying that selected blade. The coding can be with letters or symbols, for example Braille symbols or internationally recognized functional symbols, or with recognizable textures in the external gripping surfaces of the knife body, or with other means. This coding can be unobtrusive, so that it does not interfere with holding the knife, but still recognizable to the touch. With minimal experience, the user of the knife learns to recognize the position of the knife from the tactile coding.

In one embodiment, the knife blades are held in the closed position within the knife body by a weak detent mechanism. The selected blade is moved from the closed to the open position, against the detent, by the single hand of the user. The blade positively locks in the open position for use. Any operable type of locking mechanism may be used. Preferably, the locking mechanism is one that can be released with one hand and minimal attention. A most preferred locking mechanism utilizes a double side lock plate and knife sidepiece that permit the user to lock either of two blades in the open position and thereafter release the lock, all with one hand. This double side lock approach has the added advantage that the knife uses relatively few parts and is therefore simple and inexpensive to construct.

The present invention thus provides an important advance in the art of knife technology. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
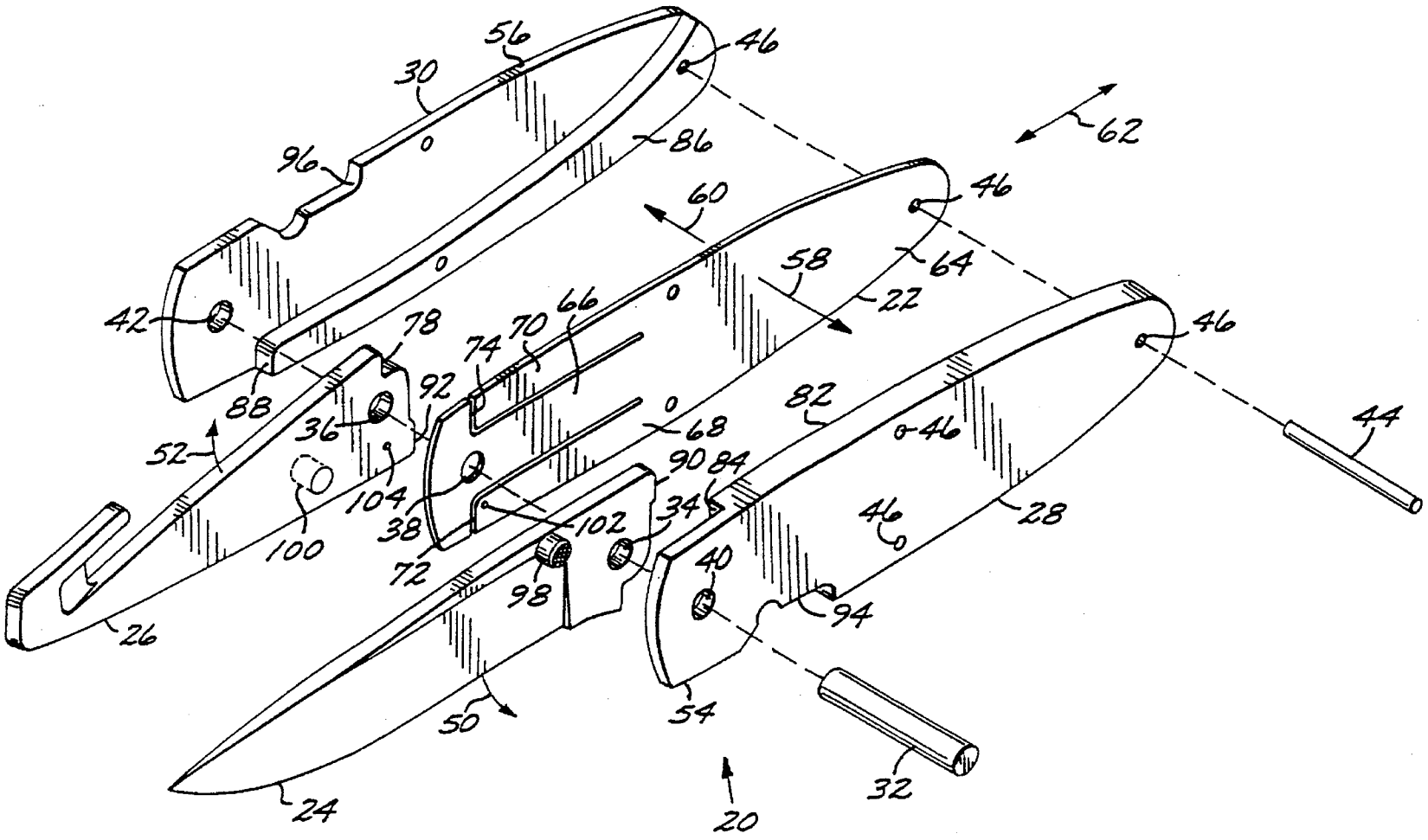
FIG. 1 is a perspective exploded view of one embodiment of the knife of the invention.

A folding knife 20 according to a preferred embodiment of the invention is shown in FIGS. 1–5. (The term "folding knife" is commonly used to describe knives wherein the blades are contained within the body of the knife when closed, and are pivoted about a pivot pin to an opened position.) The knife 20 utilizes a side lock plate 22 operable to lock two blades, a first blade 24 and a second blade 26. The side lock plate and the blades are preferably made of steel, and most preferably a stainless steel of any type known in the art. In the figures, the first blade 24 is depicted as a conventional single-sided cutting blade, and the second blade 26 is depicted as a hooked blade that may be used by law enforcement and emergency personnel to cut fabric webs such as a seat belt to free a trapped person. As used herein, the term "blade" includes conventional single-edged cutting blades and other types of implements known for use in a folding knife format. Such implements can include, for example, screwdrivers, scissors, pliers, saws, can openers, gut hooks, awls, and the like, in addition to conventional single-edged cutting blades. The present invention is not restricted as to the types of blades used, and is operable with all types of blades known to the inventors.

The side lock plate 22 is positioned between and parallel to the pivoting planes of the two blades 24 and 26. A first sidepiece 28 overlies and is positioned outside of the first blade 24, so that the first blade 24 is disposed between the first sidepiece 28 and the side lock plate 22. A second sidepiece 30 overlies and is positioned outside of the second blade 26, so that the second blade 26 is disposed between the second sidepiece 30 and the side lock plate 22.

A common pivot pin 32 extends through aligned bores 34 and 35 in the blades 24 and 26, respectively, so that the blades pivot about that pivot pin 32. As a convenience in construction and assembly, the pivot pin 32 typically extends through commonly aligned bores 38 40, and 42 in the side lock plate 22, the first sidepiece 28, and the second sidepiece 30, respectively. The use of a single pivot pin for both blades 24 and 26 permits the blades to be pivoted and deployed to their open positions at different times, without turning the knife 20 end-for-end, as in some other types of folding knives.

The knife 20 of the invention is formed as the separate elements 22, 24, 26, 38, 30, and 32. The side lock plate 22 and the sidepieces 28 and 30 are provided with commonly aligned rivet holes 44. To assemble the knife 20, the elements 22, 24, 26, 28, and 30 are stacked in the proper order into an assembly jig. The pivot pin 32 is placed through the commonly aligned bores 34, 36, 38, 40, and 42. (Rivets 44 (or screws) are fastened through the rivet holes 46 (only one of the rivets 44 is shown to avoid clutter in the drawings. The pivot pin 32 also acts as a rivet, as its ends are upset during assembly.

Figure 5:
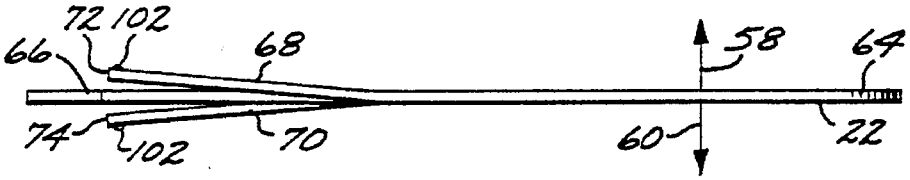
FIG. 5 is a top view of the side lock plate of FIG. 1, as it is manufactured and without any external constraints.

Alternatively, the sidepieces 28 and 30 can be formed as a single molded sidepiece unit 47, shown in FIG. 5. Such a sidepiece unit 47 can be conveniently fabricated by plastic injection molding, for example. In this case, a bridge is formed between side piece segments 28' and 30' to hold the side piece segments in their proper positions. The other elements 22, 24, 26, 92, and 44 are assembled to this single sidepiece unit 47 in the manner described.

Returning to the embodiment of FIGS. 1–5, when assembled the integral unit formed of the sidelock plate 22 and the sidepieces 28 and 30 is termed a body 48 of the knife. The blades 24 and 26 fold into the body 48 in their respective closed positions (shown in FIG. 2 for the first blade) and fold out of the body 48 to their respective open positions (shown in FIG. 3 for the first blade). The first blade 24 and the second blade 26 pivot in respective planes that are parallel to each other and to the plane of the side lock plate 22 as the blades are moved between their respective open and closed positions.

A desirable feature of the present knife 20 is that the blades 24 and 26 are contained entirely within the body 48 when they are in the closed position. The locking structure is also contained entirely within the profile or outline of the body 48. Only the small flick projections, to be discussed subsequently, may optionally extend slightly above the smooth sides, top, and bottom of the knife. Consequently, there are no (or very minor) projections on the knife 20 that can snag on clothing or injure the user of the knife (as by gouging into the user's hand) during service.

A further aspect of the preferred knife 20 is that the blades 24 and 26 move between their respective open and closed positions by rotation in opposite directions about the pivot pin 32. That is, as shown by the arrow 50 in the view of FIG. 1, the first blade 24 moves from its open to its closed position by a counterclockwise movement. The second blade 24 moves from its open to its closed position by a clockwise movement, arrow 52. Stated alternatively, defining a top 54 and a bottom 56 of the knife, the first blade opens through the top 54 and the second blade opens through the bottom 56.

In describing the details of the construction and operation of the knife 20, it is useful to define two directions perpendicular to the side lock plate 22. A first perpendicular direction 58 extends perpendicularly out of the side lock plate 22 toward the first blade 24 and the first sidepiece 28. A second perpendicular direction 60 extends perpendicularly out of the side lock plate 22 toward the second blade 26 and the second sidepiece 30. A longitudinal axis 62 of the knife extends along its long direction.

Turning to the details of the elements of the knife, the side lock plate 22 is formed with four regions. In the preferred construction, these four regions are integrally connected in a slotted plate structure, but in an alternative approach separate pieces could be fabricated and joined. The side lock plate 22 includes a plate base 64 at the end of the side lock plate 22 remote from the blades 24 and 26 and from the pivot pin 32. A T-shaped plate central region 66 extends from the plate base 64 parallel to the longitudinal axis 62, with the bore 38 through the "T" shaped region 66.

On either side of the central region 66 are fingers 68 and 70. The first finger 68 is bent or sprung in the first perpendicular direction 58, and therefore biased in this direction 58. The second finger 70 is bent sprung in the second perpendicular direction 60, and therefore biased in this direction 60. The bending of the fingers 68 and 70 is not seen in the exploded view of FIG. 1, as when the knife is assembled the fingers are pressed flat by their contact with the respective adjacent blades 24 and 26. FIG. 5 shows the side lock plate 22 as it is manufactured, with the fingers 68 and 70 in their bent and biassed positions. The extended, bent positions of the two fingers 68 and 70, as shown in FIG. 5, are termed their respective finger locking positions.

The first finger 68 has a first finger locking shoulder 72 thereon at the end of the first finger 68 adjacent to the T cross bar of the central region 66. Similarly, the second finger 70 has a second finger locking shoulder 74 at the end of the second finger 70 adjacent to the T cross bar of the central region 66. The cooperation of these finger locking shoulders 72 and 74 with their respective blades 24 and 26 will be described subsequently.

The first blade 24 has a first blade locking shoulder 76 at the end of the blade remaining within the body 48 of the knife 20, when the first blade 24 is opened. The second blade 26 has a second blade locking shoulder 78 at the end of the blade remaining within the body 48 of the knife 20, when the second blade 26 is opened. The respective blade locking shoulders 76 and 78 are positioned on the blades so as to engage the respective finger locking shoulders 72 and 74, when the respective blades 24 and 26 are opened to their open position, thereby providing the respective blades 24 and 26 with positive open-position locks that prevent the blades 24 and 26 from closing until the locks are released.

Figure 2:
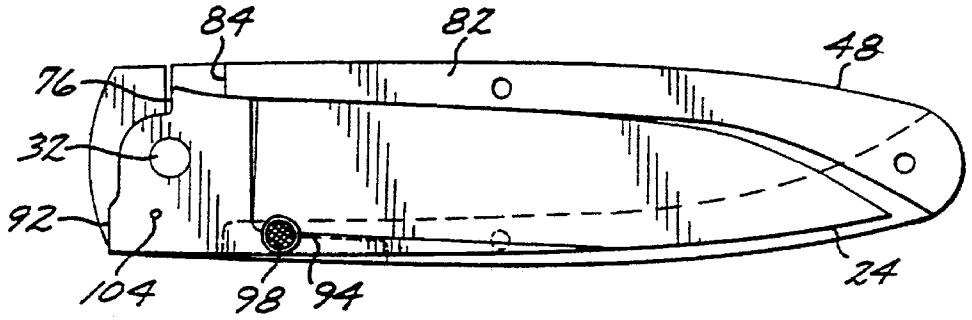
FIG. 2 is a side view of the knife of FIG. 1 showing the first blade in the closed position and with portions of the structure in phantom view.

The operation of the locks can be seen by referring to FIGS. 2–4 and 7–8, which show the operation of the open-position lock for the case of the first blade 24. The operation of the open-position lock for the second blade 26 is similar. In FIG. 2, the blade 24 is in the closed position within the body 48. The side of the blade 24 compresses the first finger 48 from the extended, finger locking position shown in FIG. 5 to the flat position shown in FIG. 1, so that the first finger 48 is coplanar with the central region 66.

Figure 6:
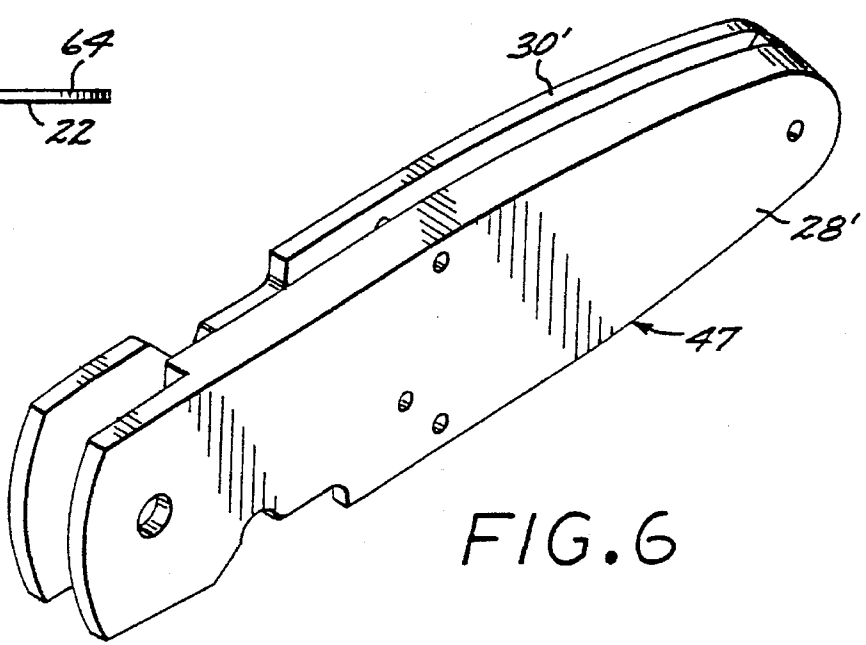
FIG. 6 is a perspective view of an integral sidepiece structure.
Figure 8:
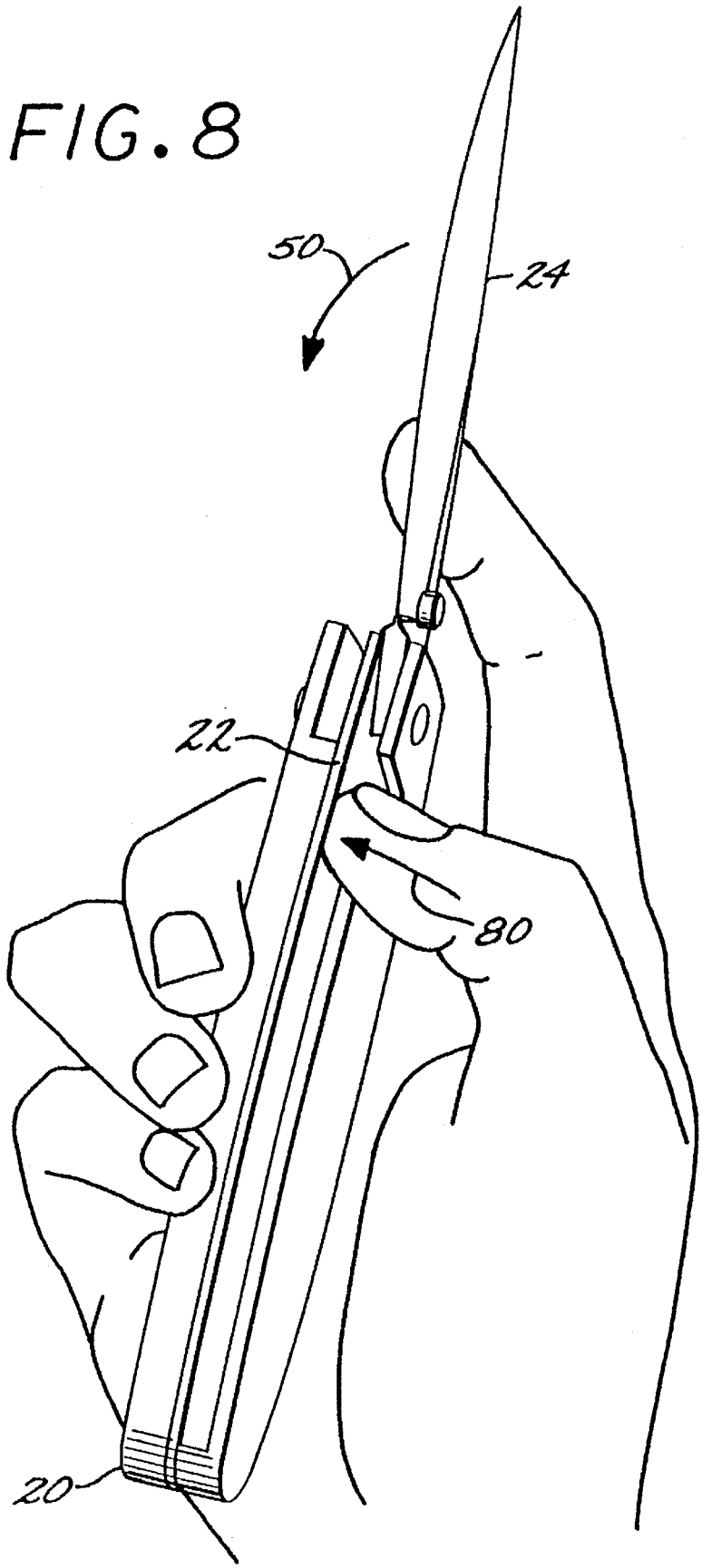
FIG. 8 is a perspective view of the knife of the invention held in a hand during unlocking and closing of one of the blades.

As the blade 24 is opened (by a clockwise rotation progressing as shown in FIG. 6 from the view of FIG. 2 to that of FIG. 3), the inward compressive force on the first finger 48 is released and the first finger 68 springs outwardly in the first perpendicular position 58. When the first blade 24 is in its fully open position shown in FIG. 3, the first finger locking shoulder 72 engages the first blade locking shoulder 76, as may be seen in FIG. 4. The first blade 24 is thereby locked into the fully open position by this positive lock. The first blade cannot be rotated back (counterclockwise) to the closed position until the lock is released. The lock is released when the user manually presses against the side of the first finger 68, as indicated by the arrow 80 in FIG. 4 and as depicted in FIG. 8. The structures which aid in opening and permit easy manual access to the side of the first finger 68 to achieve unlocking of the blade will be described subsequently.

The open position lock just described prevents the blade from closing unless the lock is released. The blade must also be prevented from rotating too far, past the blade open position shown in FIGS. 1 and 3. To provide this blade stop function, the first sidepiece 28 has an inward (toward the side lock plate 22) first sidepiece projection 82 with a first sidepiece stop shoulder 84 thereon. Similarly, the second sidepiece 30 has an inward (toward the side lock plate 22) second sidepiece projection 86 with a second sidepiece stop shoulder 88 thereon. The first and second sidepiece stop shoulders 84 and 86 face toward the end of the knife 20 where the blades 24 and 26 are attached with the pivot pin 32. The cooperation of these stop shoulders 84 and 86 with their respective blades 24 and 26 will be described subsequently.

The first blade 24 has a first blade stop shoulder 90 at the end of the blade remaining within the body 48 of the knife 20, when the first blade 24 is opened. The second blade 26 has a second blade stop shoulder 92 at the end of the blade remaining within the body 48 of the knife 20, when the first second 26 is opened. The respective blade stop shoulders 90 and 92 are positioned on the blades so as to butt against the respective sidepiece stop shoulders 84 and 88, when the respective blades 24 and 26 are opened to their open positions, thereby providing the respective blades 24 and 26 with positive stops that prevent the blades 24 and 26 from rotating past their desired fully open positions when the blades lie parallel to the longitudinal axis 62.

The operation of the stops can be seen by referring to FIGS. 2–9, which show the operation of the stops for the case of the first blade 24. The operation of the stop for the second blade 26 is similar. In FIG. 2, the blade 24 is in the closed position within the body 48. The stops do not come into play.

Figure 3:
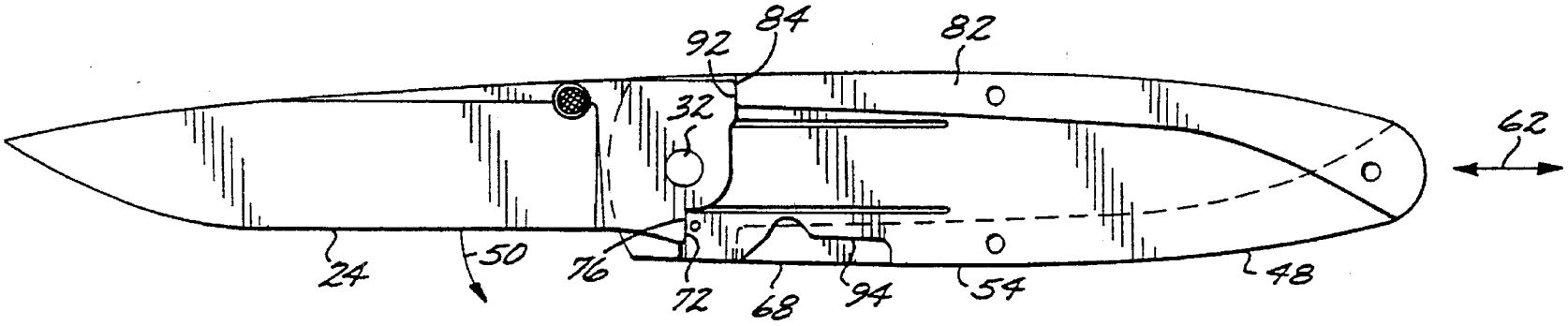
FIG. 3 is a side view of the knife of FIGS. 1 and 2 with the first blade in the open position and with portions of the structure in phantom view.

As the blade 24 is opened (by a clockwise rotation progressing from the view of FIG. 2 to that of FIG. 3) to the point that it is in its fully open position shown in FIG. 3, the first sidepiece stop shoulder 84 butts against the first blade stop shoulder 90. The clockwise rotation of the first blade 24 is thereby stopped so that it cannot be rotated further. In combination with the open position lock described previously, the stop structure rigidly locks the blade 24 so that it cannot rotate in either direction from its fully open position, unless the open position lock is released.

The opening and closing of the knife blades are facilitated by providing a cutout in each of the sidepieces and a cooperating element on the respective blades. Thus, a first sidepiece cutout 94 is formed in the first sidepiece 28 along the edge of the first sidepiece adjacent the knife top 54. Similarly, a second sidepiece cutout 96 is formed in the second sidepiece 30 along the edge of the first sidepiece adjacent the knife bottom 56.

Figure 4:
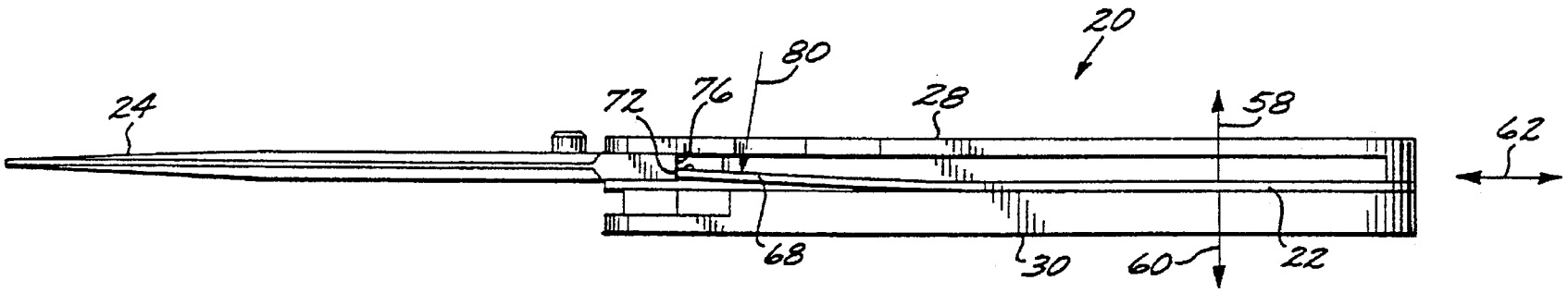
FIG. 4 is a top view of the knife of FIG. 3, with the first blade in the open and locked position and with portions of the structure in phantom view.

As an aid in opening the knife blades 24 and 26, flick projections are formed on the sides of the knife blades. As seen in FIGS. 1 and 4, a first blade flick projection 98 is formed in the first perpendicular direction 58 on the side of the first blade 24 facing the first sidepiece 28. As seen in FIG. 1 in a phantom view, a second blade flick projection 100 is formed in the second perpendicular direction 60 on the side of the second blade 26 facing the second sidepiece 28.

Figure 7:
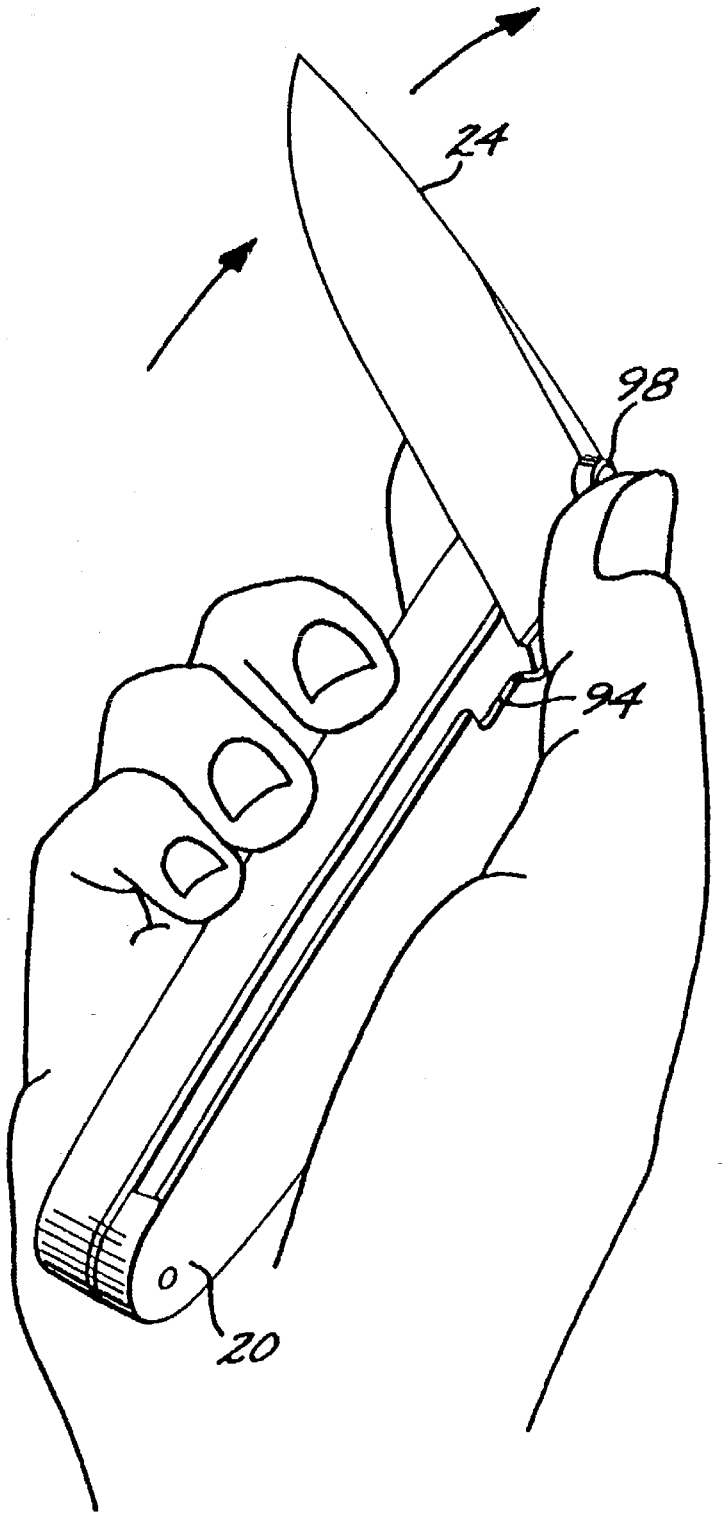
FIG. 7 is a perspective view of the knife of the invention held in a hand during opening of one of the blades.

The use of the flick projections in opening of the blades can be seen by referring to FIGS. 2 and 7, which show the opening operation for the case of the first blade 24. The operation of the stop for the second blade 26 is similar. When the first blade 24 is In the closed position, FIG. 2, the first blade flick projection 98 is received within the first side,piece cutout 94. The first blade flick projection 98 is preferably made no longer than the thickness of the first sidepiece 28 in the region of the first sidepiece cutout 94, so that it does not project out of the body 48 and provide a possible source of snags when the knife 20 is removed from the pocket of the user. However, because its rounded shape has little likelihood of causing a snag, the first blade flick projection 98 may be made about the same length or even slightly greater in length than the thickness of the first sidepiece 28 without having a significant adverse effect on the smooth-surface, antisnag characteristics of the knife. Making the first blade flick projection 98 slightly longer than the thickness of the first sidepiece 28 may improve the ease of opening the first blade 24 using the flick projection 98.

To open the first blade 24 from the closed position of FIG. 2, the user holds the knife in one hand and applies pressure with the thumb (or one of the fingers, but preferably the thumb) against the first blade flick projection 98 as shown in FIG. 7, and continues that pressure until the first blade rotates to the open position of FIG. 3 and locks at that position in the manner described previously.

The unlocking of the blade open lock is also facilitated by the sidepiece cutout for that blade, as can be seen by referring to FIGS. 3 and 8, which show the manner of releasing the lock for the case of the first blade 24. The releasing of the lock for the second blade 26 is similar. When the first blade 24 is in the open position, a portion of the first finger 68 is accessible to the thumb (preferably) or the finger of the user of the knife through the first sidepiece cutout 84. The user applies pressure to the first finger 68 in the region exposed through the first sidepiece cutout 94, in the direction 80 against the bias force of the first finger 68. Simultaneously, the user rotates the first blade 24 in the counterclockwise direction 50 (of FIGS. 3 and 8), past the point where the first finger locking shoulder 72 engages the first blade locking shoulder 76. From this point onward in the closing of the first blade 24, there is no need to continue to apply pressure to the first finger 68, as the side of the first finger 68 rides over the adjacent side of the first blade 24.

When the blades 24 and 26 are closed, they can be retained in the closed position by frictional force, a spring, or any other operable mechanism. A preferred approach is a ball-detent mechanism. With the ball detent mechanism, a small recess is made in the side of the fingers 68 and 70 that face outwardly toward the respective sides 28 and 30. A steel ball 102, preferably about 0.020 inches in diameter, is placed into each of the recesses during assembly of the knife. Each of the steel balls 102 is captured between its respective finger 68 or 70 and the facing side of the respective blade 24 or 26. As the blades 24 or 26 are opened or closed, the balls 102 act as ball bearing to ensure a smooth pivoting motion. A closed-position retention recess 104 is formed in each of the sides of the respective blades 24 and 26 that face the respective steel balls 102, at a location such that the respective balls 102 roll into the respective recesses 104 when the respective blades reach their desired closed positions. As the ball 102 falls into the recess 104, the finger upon which the ball is supported relaxes outwardly by a small amount. To open the blade from this closed position, a small force must be exerted to force the finger inwardly. The blade is thereby retained in the closed position by this detent mechanism until a small force is exerted to open the blade.

A prototype knife has been constructed according to the preferred embodiment discussed above and depicted in FIGS. 1–5. Experience with the knife validated the various mechanisms and structures discussed herein. When the knife was held in one hand, pressure by the thumb of the user against the blade flick projection moved the blade from the closed position toward the open position as shown in FIG. 7. The pressure applied with a extending and circling motion of the thumb brought the blade to the fully open position where it was stopped and then locked into position. When the blade was to be closed, the thumb was pressed against the side of the first finger 68 through the sidepiece cutout to unlock the blade lock mechanism as shown in FIG. 8, and at the same time the index finger rotated the blade to the closed position where it achieved a weak retention with the detent. During all of these operations, the knife was readily grasped firmly within the palm and remaining fingers of the user. One handed operation, a desirable feature many knife users, is readily obtained.

When the knife was held and opened in the manner just described, the blade rotated away from the hand of the user. To use the other blade, the user closed the first-used blade. The user rotated the entire knife 180 degrees about the longitudinal axis 62 using only the hand holding the knife, so that the other blade opened away from the hand of the user. Then the one-handed opening, locking, unlocking, and closing motions previously described were used, for the other blade.

By this approach, the user of the knife could select the blade to be used and fully operate the knife, entirely with one hand. With a minimal amount of practice to develop coordinated movements, the user could operate the knife with little thought to the mechanics of the operation. The user was free to devote the use of the other hand and most of his or her attention to the use of the knife rather than the operation of the knife.

It is recognized that the use of a knife having at least two blades involves two distinct steps: first, selecting the blade to be used and positioning the knife in the hand so that the blade is ready for use (even though in a closed position, and, second, operating the blade in opening, locking, unlocking, and closing functions.

Figure 9:
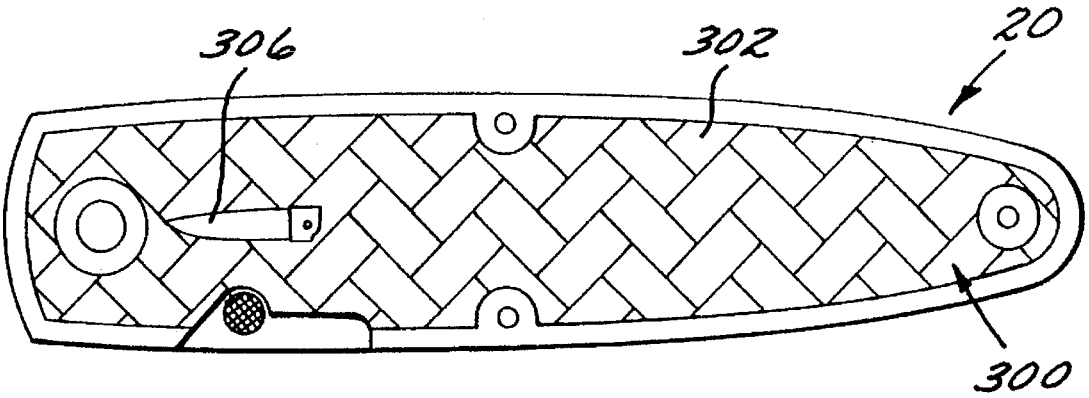
FIG. 9 is a side elevational view of tactile coding on a first side of the knife of FIG. 1.
Figure 10:
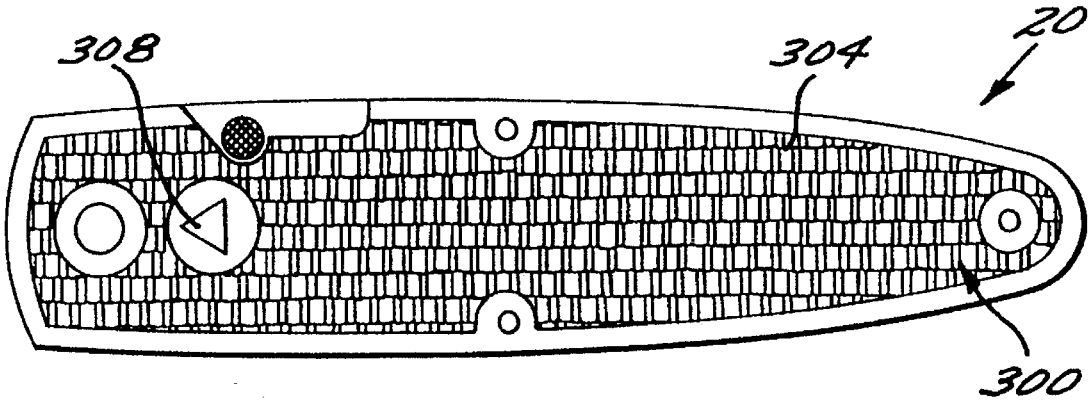
FIG. 10 is a side elevational view of the tactile coding on a second side of the knife of FIG. 1.

To aid in the selecting function, the knife 20 may be provided with coding that allows the user to tactilely distinguish between the two sides of the knife, and thence which of the two blades is in a position to be opened away from the hand of the user. FIGS. 9 and 10 illustrate some tactile coding approaches that can be used. The knife 20 is desirably provided with a grip surface 300 made of a natural or synthetic material such as rubber, plastic, or other material that provides a firm, nonslipping grip for the user. One tactile coding approach is to provide different textures to the grip surface 300 on the different sides of the knife. For example, on a first side as shown in FIG. 9, a rougher texture 302 is provided on the grip surface 300, and on a second side as shown in FIG. 10, a smoother texture 304 is provided. Such texture differences do not interfere with the gripping of the knife, but do provide a tactile code for distinguishing between the sides of the knife and thence the blade that is positioned for opening.

A second tactile coding approach utilizes symbols. For example, in FIG. 9 a raised pictorial symbol 306, here a symbolic representation of the blade 24 that will be selected when the symbol 306 is felt against the thumb of the user of the knife, is placed on the first side of the grip surface 300. In FIG. 10 a raised internationally recognized triangular symbol 308 is placed on the second side of the grip surface 300. Other types of tactile coding could also be used, such as a coding on one side but not the other, letters, Braille symbols, etc. The several different types of coding in FIGS. 9 and 10 are shown for illustration. In most cases, only one of the types of tactile coding (e.g., symbols or texture) would be needed and used.

When the user of the knife grasps the knife in one hand in the conventional fashion, the coding on the gripping surface of the knife handle permits the user to recognize the orientation of the knife without visually inspecting the knife. If the desired blade is oriented for opening away from the single hand of the user, the knife is ready for use. If the desired blade is oriented for opening into the single hand of the user, the user need only rotate the knife by 180 degrees about its longitudinal axis, sense the ceding on the side of the knife brought into position by this rotation, and use the knife.

The tactile coding enables the user to accomplish blade selection without visual inspection of the knife. If the previously described structure for one-handed operation of the blades as described previously are also provided, the selecting, positioning, opening, locking, unlocking, and closing of a desired blade can be accomplished with a single hand and without visual inspection of the knife. This capability is highly desirably for many knife users, so that the second hand and the primary attention of the user can be directed elsewhere, and in particular toward the primary application for which the knife is being used.

Figure 11:
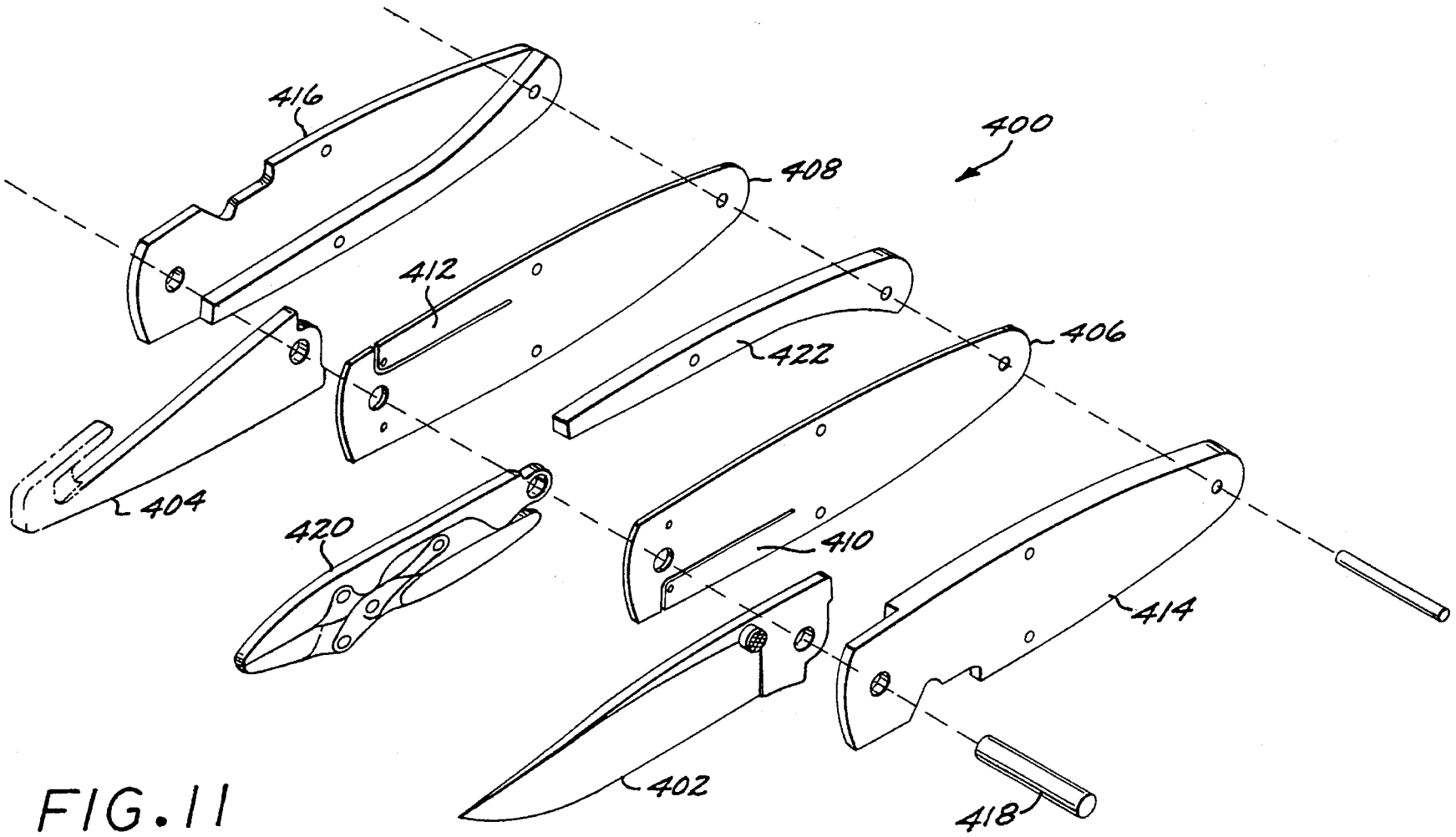
FIG. 11 is a perspective exploded view of a further embodiment of the knife of the invention.

In a further variation of the knife of the invention, single side lock pieces can be used in a manner so as to permit the rollover feature to be used with additional blades as well. FIG. 11 depicts this embodiment. Inasmuch as many of the features and functions of individual elements are the same as described for the knife 20, the prior description is incorporated to that extent.

A knife 400 has a first blade 402 and a second blade 404. The first blade 402 has an associated first single side lock plate 406, and the second blade 404 has an associated second single side lock plate 408. The first side lock plate 406 has a single first finger 410 disposed to engage the first blade 402 and lock it closed in the manner discussed previously. The second side lock plate 408 has a single first finger 412 disposed to engage the second blade 404 and lock it closed in the manner discussed previously. A first side piece 414 overlies the first side lock plate 406, and a second side piece 416 overlies the second side lock plate 408. The side lock plates 414 and 415 have the same stopping structure as described previously, and also may be made as a single injection molded unit. A common pivot pin 418 extends through bores in the blades 402 and 404, the side lock plates 406 and 408, and the side pieces 414 and 416.

Additional blades can also be provided in the knife 400. A single additional blade, here depicted as a pliers blade 420, is shown in FIG. 11, but the same principles of construction can be used to add more blades to the knife 400. The pliers blade 420 is pivoted about the same pivot pin 418 as the other blades 402 and 404. The blade 420 is retained in the closed position and locked into the extended position by any suitable retention and locking mechanism. Here, a conventional spring arm 422 presses against the back of the blade 420 to provide both retention and open-lock (but not positive open lock) functions. A positive open lock could be provided, for example, by a conventional lock-back mechanism.

The knife 400 permits the addition of more blades, but at the cost of increased weight and complexity of the knife. In some cases the increased weight and complexity may be warranted, however. The rollover feature for the outermost blades (here blades 402 and 404) is retained, while providing the other blades (here blade 420) as well.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A folding knife, comprising:

a knife body having a first knife side and a second knife side;

a common blade pivot pin extending between the first knife side and the second knife side;

a first blade pivotably joined to the knife body at the common blade pivot pin and disposed within the knife body in a first blade closed position, the first blade being pivotable in a first rotational direction about the common blade pivot pin from the first blade closed position to a first blade open position;

a second blade pivotably joined to the knife body at the common blade pivot pin and disposed within the knife body in a second blade closed position, the second blade being pivotable in a second rotational direction opposite to the first rotational direction about the common blade pivot pin from the second blade closed position to a second blade open position; and locking means for controllably locking the first blade in the first blade open position and for independently and controllably locking the second blade in the second blade open position, and wherein the locking means includes a side lock mechanism having a double side lock plate positioned between the first blade and the second blade.

2. The folding knife, comprising;

a knife body having a first knife side and a second knife side;

a common blade pivot pin extending between the first knife side and the second knife side;

a first blade pivotably joined to the knife body at the common blade pivot pin and disposed between the first knife side and the second knife side within the knife body in a first blade closed position, the first blade being pivotable in a first rotational direction about the common blade pivot pin from the first blade closed position to a first blade open position;

a second blade pivotably joined to the knife body at the common blade pivot pin and disposed between the first knife side and the second knife side within the knife body in a second blade closed position, the second blade being pivotable in a second rotational direction opposite to the first rotational direction about the common blade pivot pin from the second blade closed position to a second blade open position;

locking means disposed between the first knife side and the second knife side for controllably locking the first blade in the first blade open position and for independently and controllably locking the second blade in the second blade open position; and means on an external surface of the knife body, and located on at least one of the first knife side and the second knife side, for tactilely distinguishing the first knife side from the second knife side, wherein the means for tactilely distinguishing includes a first texture on the first knife side and a second texture on the second knife side.

3. The folding knife of claim 1, wherein the locking means comprises first opening means for opening the first blade from the first blade closed position to the first blade open position with a single hand of the user of the knife, and first blade lock release means for releasing the first blade from the locked first blade open position with a single hand of the user of the knife.

4. The folding knife of claim 3, wherein the locking means further comprises second opening means for opening the second blade from the second blade closed position to the second blade open position with a single hand of the user of the knife, and second blade lock release means for releasing the second blade from the locked second blade open position with a single hand of the user of the knife.

5. A folding knife, comprising:

a knife body having a first knife side, a second knife side, a knife top, a knife bottom, and a knife longitudinal axis;

at least a first blade and a second blade joined to the knife body, each blade being movable from a closed position within the knife body to an open position extended from the knife body;

means for selecting between the first blade and the second blade for moving from its closed position to its opened position, the means for selecting being operable at least in part by the knife about the knife longitudinal axis in a single hand of a user of the knife, means for selecting including coding means on an external surface of the knife body, and located on at least one of the first knife side and the second knife side, for tactilely distinguishing the first knife side from the second knife side, wherein the means for tactilely distinguishing includes a first texture on the first knife side and a second texture on the second knife side.

* * * * *